US007045974B2

(12) United States Patent
Lin et al.

(10) Patent No.: US 7,045,974 B2
(45) Date of Patent: May 16, 2006

(54) LED OPTICAL ENERGY DETECTION AND FEEDBACK SYSTEM

(75) Inventors: Yi-Fang Lin, Kaohsiung Hsien (TW); Ming-Hsiang Yu, Tainan (TW); Jyh-Chang Lin, Fengshan (TW); Yun Yun Wang, Taipei (TW); Yen Chuan Chu, Kaohsiung (TW); Ying-Fu Wang, Taipei (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 0 days.

(21) Appl. No.: 10/921,120

(22) Filed: Aug. 19, 2004

(65) Prior Publication Data

US 2006/0038509 A1 Feb. 23, 2006

(51) Int. Cl.
*G05F 1/00* (2006.01)

(52) U.S. Cl. ..... 315/308; 315/152; 315/155; 250/204; 250/205; 250/553

(58) Field of Classification Search ..... 315/149–155, 315/185 R, 291, 307–308; 362/558–559, 362/555, 561; 250/204–205, 553; G05F 1/00
See application file for complete search history.

(56) References Cited

U.S. PATENT DOCUMENTS

| | | | | |
|---|---|---|---|---|
| 6,441,558 | B1 * | 8/2002 | Muthu et al. | 315/149 |
| 6,459,919 | B1 * | 10/2002 | Lys et al. | 600/407 |
| 6,594,014 | B1 * | 7/2003 | Yokozawa et al. | 356/425 |
| 6,633,301 | B1 * | 10/2003 | Dallas et al. | 345/597 |
| 2003/0234759 | A1 * | 12/2003 | Bergquist | 345/92 |
| 2005/0058450 | A1 * | 3/2005 | Yamamoto et al. | 398/25 |

* cited by examiner

*Primary Examiner*—Thuy Vinh Tran
(74) *Attorney, Agent, or Firm*—Leong C. Lei

(57) ABSTRACT

A system for the throughput detection and feedback of optical energy for making sure of white balance of the LED array in a flat fluorescent light source when the LED array in emitting light by respectively connecting in series a selected LED lamp respectively from RGB LED groups in an LED array to an optical energy sensor to convert optical energy into equivalent amperage, then voltage analog signals to digital signals for a CPU to compare and solve the difference of optical energy to improve voltage output, which then regulated by a driver and fed back to the LED array.

1 Claim, 3 Drawing Sheets

LED OPTICAL ENERGY DETECTION AND FEEDBACK SYSTEM

BACKGROUND OF THE INVENTION (a) Technical Field of the Invention

The present invention is related to a light emitting diode (LED) optical energy detection and feedback system, and more particularly, to one that executes throughput detection and feedback when the LED array in a flat fluorescent light (FFL) source is emitting light to make sure the white balance of the LED array light source.

(b) Description of the Prior Art

The FFL source is a very important light source for the LCD. As illustrated in one, an FFL source 1 of the prior art is essentially comprised of a light guide plate 10, multiple light diffusion devices 11 are disposed on the light emitting plane of the light guide plate 10 to serve as the light convergence 12 that converges and guide the correct light emitting direction. Multiple light guide points 103 in extremely great number are provided on a reflection plane 102 of the light guide plate 10, a reflection plate 103 is adhered onto the reflection plane 102. One incidence plane 104 as a minimum is provided in the light guide plate 10 and an LED array 14 of LED (light emitting diode) lamps are disposed external to the light incidence plane 104. The LED array 14 is comprised of a red LED lamp set 141, a green LED lamp set 142, and a blue LED lamp set 143 connected in series.

As illustrated in FIG. 2, all three RGB LED lamp sets 141, 142, 143 of the LED array 14 emit light at the same time to the incidence plane 104 of the light guide plate 10 while mixing the light colors into a final white light source to forthwith transmit into the light guide plate 10, deflected through those multiple light guide points 103 and the reflection plate 102 to the light diffusion device 11 where the light source is softened before being converged by the light convergence device 12 to leave the FFL source 1 for the liquid crystal panel.

Furthermore, before the assembly, it must be tested and confirmed that every LED in each of the red LED set 141, the green LED set 142, and the blue LED set 143 respectively provides the same characteristics in its LED set by conducting each LED an identical amperage of current to screen parameters measured in three close frequencies of light strength, color, and v/f to be further classified (Bin). To meet the preset white light performance after the mix of LED light colors, i.e., the white balance, RGB LED sets are respectively selected depending on the specification requirements of the product and the allowances set forth by respectively LED manufactures of the individual color for final assembly of the LED array 14.

However, after the operation for a certain period of time, some device may become weak and instable. It is usually found that a certain LED lamp set in the LED array 14 is observed with poor performance in optical energy resulting in the failure of the white light mixed by the entire LED array 14 to meet white balance conditions, thus to compromise the subsequent application of the light source. Whereas the failure in meeting white light balance conditions is usually found after the product has been delivered to the end-user, there is no way to determine which set or how many sets of the LED went wrong. The modulus design of the product makes practically impossible to follow up with any betterment or repair. Therefore, how to maintain detect the output of the optical energy from each LED lamp set at any time and from time to time after the LED array 14 is adapted to the FFL 1, followed with the remedies as required depending on the detection results remains the bottleneck pending an urgent breakthrough by the trades concerned.

SUMMARY OF THE INVENTION

The primary purpose of the present invention is to provide a system for LED energy detection and feedback to make sure that the LED array meets the source white light balance requirements. To achieve the purpose, an LED sensor is each connected in series to RGB lamp sets in a flat fluorescent lamp source to carry out throughput detection and provide in-time feedback to the current when the LED array is activated to emit light.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
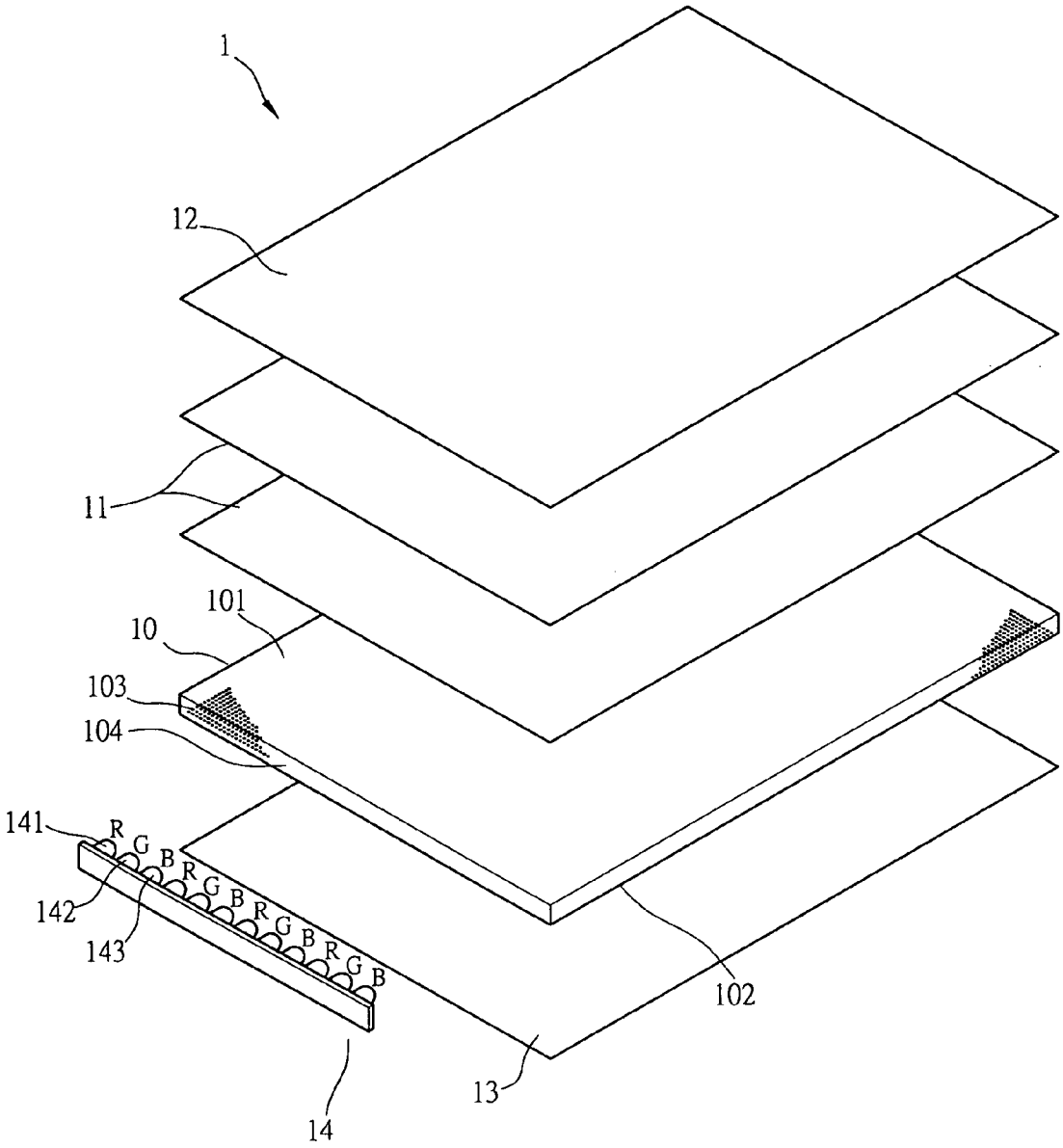
PRIOR ART FIG.1
FIG. 1 is an exploded view of a flat fluorescent light system of the prior art.
Figure 2:
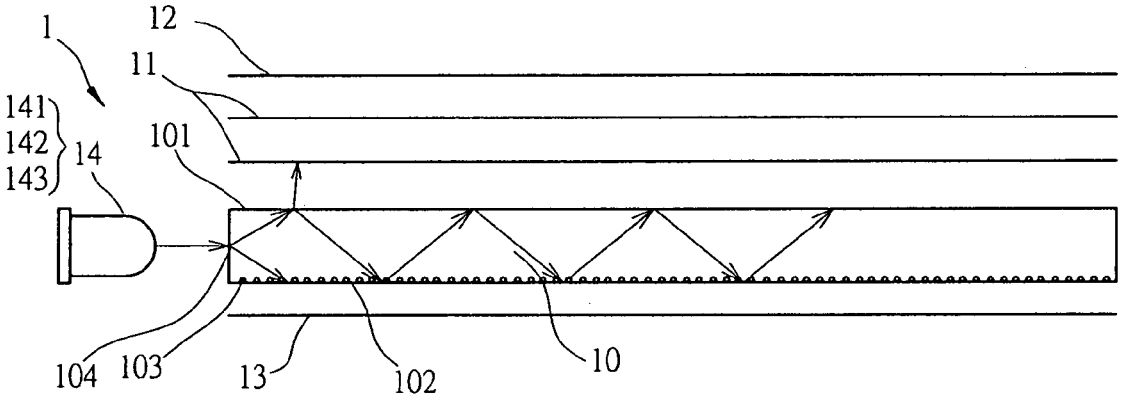
PRIOR ART FIG.2
FIG. 2 is a schematic view showing an assembly of the prior art.
Figure 3:
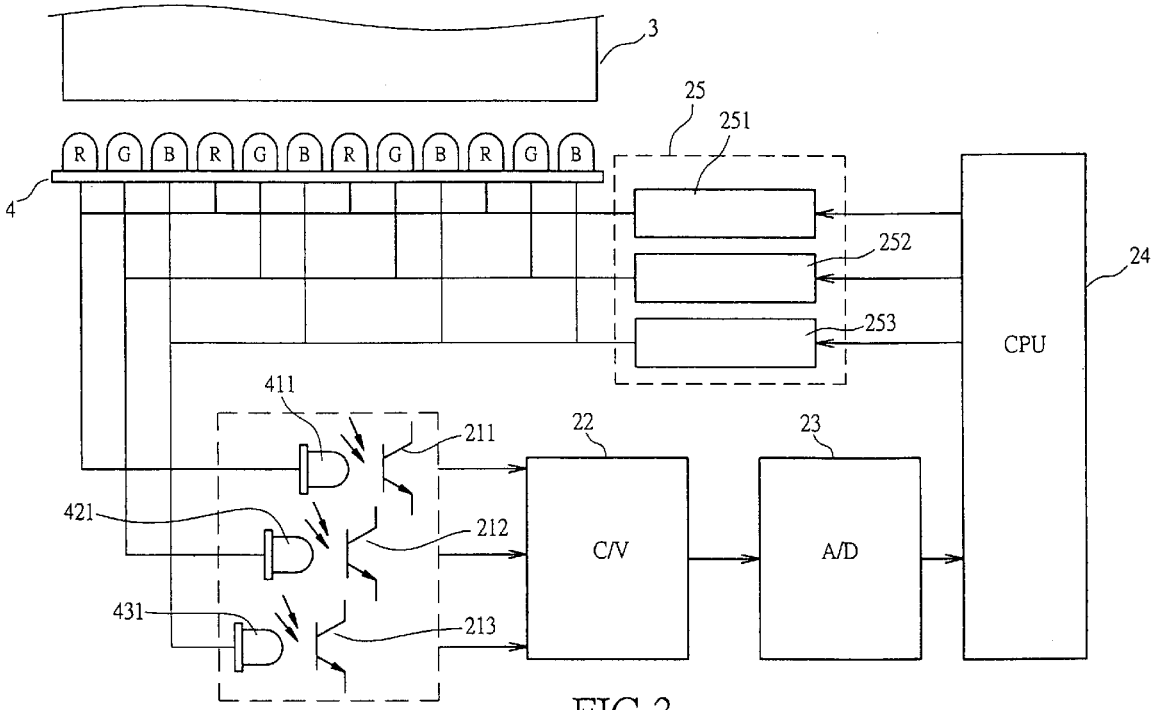
FIG. 3 is a block chart of an LED optical energy detection and feedback system of the present invention.

Referring to FIG. 3, an LED optical energy detection and feedback system 2 of the present invention includes an optical energy sensor, a CN converter 22, an A/D converter 23, a CPU 24, and an LED driver IC 25. Wherein, the optical energy sensor is comprised of multiple phototransistors 211, 212, 213. The C/A converter 22 converts the current (electric charge) into voltage for output. The A/C converter 23 converts analog signals into digital signals for output. The CPU 24 is preset with the parameters for each light color in the optimal balance status of the white light after the mix of RGB colors, and provided with three pulse width modulation units 211, 212, 213 to respectively change voltage output and frequency control. The LED driver IC 25 is comprised of three drivers ICs 251, 252, 253 to accept the commands from the CPU 21 to carry out current regulation.

In practice, an LED array 4 comprised of a red LED lamp set, a green LED lamp set and a blue LED lamp set, is provided in a flat fluorescent light (FFL) source 3. All three RGB LED lamp sets have been screened by test so that all the LED lamps in each LED lamp set meets the same standard of characteristics. The red LED lamp set is connected in series to a red LED lamp 411 of same characteristics for detection; the green LED lamp set is connected in series to a green LED lamp 412 of same characteristics for detection; and the blue LED lamp set is connected in series to a blue LED lamp 413 of same characteristics for detection. The red, green, and blue LED lamps 411, 412, 413 for detection are then linked to the optical energy sensor. Those phototransistors 211, 212, 213 in the optical energy sensor are matched to one another, each is capable of receiving the light emitted respectively by RGB LED lamps 411, 421, 431 for detection, and each relates to an optical semiconductor to output an amperage based on the optical energy received from the light source. Accordingly, the amperage respectively outputted by those phototransistors 211, 212, 213 is sufficient to tell the difference in the optical energy respectively emitted by their matching RGB LED lamps 411, 421, 431 for detection. Different amperages respectively outputted from those phototransistors 211, 212, 213 are converted into voltages through the C/V converter 22. Analog signals of voltage are then converted into digital signals to be processed by the CPU 24 for drivers ICs 251, 252, 253 in the driver IC 25 to output their respective amperages.

In the present invention, those RGB LED lamps 411, 421, 431 for detection give the same characteristics respectively as that of those RGB LED lamp sets, and are also respectively connected in series to the optical energy sensor from those RGB LED lamp sets. Therefore, the performance of the optical energy created, as well as the on and off respectively of the ROB LED lamps 411, 421, 431 for detection in the optical energy sensor are fully identical with that of the ROB LED lamp sets in the LED array 4 to attain the accuracy of sampling. Accordingly, each of those phototransistors 211, 212, 213 matched in the optical energy sensor upon receiving their respective optical energy will output different amperages, which are then converted into voltages via the C/V converter 22. The A/D converter 23 converts analog signals of those voltages into digital signals through the A/D converter 23 to provide information for determination by the CPU 24. The CPU 24 is preset with parameters of optical energy respectively for the red light, the green light and the blue light in the optimal balance conditions of the white light. After the reading and comparison of and between those voltages in digital form and those parameters. The compensation required for any difference found between any outputted optical energy from those RGB LED lamps 411, 412, 413 for detection and the parameter preset in the CPU is solved, and one or two matching pulse width modulation units 211, 212, 213 will vary the voltage and frequency for output. The outputted voltage and frequency are then adjusted for the amperage by the respective units of the matching drivers ICs 251, 252, 253 in the driver IC 25 and fed back to the LED array 4 to complete the optical energy detection and feedback for the LED array 4. Upon the LED array 4 is activated, the present invention immediately commence the throughput detection and feedback to make sure that the light source of the LED array 4 meets the white balance requirements for reliable subsequent use of the light source.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An LED optical energy detection and feedback system comprising:

an optical energy sensor having a plurality of phototransistors;

a current/voltage converter;

an analog/digital converter;

a CPU containing respective pulse width modulation units;

a driver having three driver ICs; and an LED array having a red light LED lamp set, a green light LED lamp set, and a blue light LED lamp set, said LED lamp sets having been screened by test so that all said LED lamp sets meet same standard of characteristics, said red LED lamp set being connected in series to a red LED lamp of same characteristics for detection, said green LED lamp set being connected in series to a green LED lamp of same characteristics for detection; and said blue LED lamp set being connected in series to a blue LED lamp of same characteristics for detection, said red, green, and blue LED lamps for detection being then linked to said optical energy sensor;

said phototransistors being matched to one another, each of said phototransistors being capable of receiving light emitted respectively by said red, green and blue LED lamps for detection and relating to an optical semiconductor to output an amperage based on optical energy received from light source;

whereby each of said phototransistors matched in said optical energy sensor upon receiving respective optical energy will output different amperages which are then converted into voltages via said current/voltage converter, said analog/digital converter converts analog signals of said voltages into digital signals to provide information for determination by said CPU, said CPU being preset with parameters of optical energy respectively for red light, green light and blue light in optimal balance conditions of white light, and after reading and comparison of and between said voltages in digital form and said parameters, compensation required for any difference found between any outputted optical energy from said red, green and blue lamps for detection and said parameters preset in the CPU is solved and one or two matching pulse width modulation units will vary voltage and frequency for output, said voltage and frequency being then adjusted for amperage by respective units of matching driver ICs in said driver ICs and fed back to said LED array to complete optical energy detection and feedback for said LED array, and upon said LED array is activated, said system will immediately commence thorough detection and feedback to make sure that light source of said LED array meets white balance requirements.

* * * * *